US009959966B2

(12) United States Patent
Lin et al.

(10) Patent No.: US 9,959,966 B2
(45) Date of Patent: May 1, 2018

(54) COOLING FAN VARIABLE-FREQUENCY CONTROL SYSTEM FOR A POWER TRANSFORMER

(71) Applicant: Fortune Electric Co., Ltd., Taipei (TW)

(72) Inventors: Ming-He Lin, Taoyuan (TW); Chia-Ching Lin, Taoyuan (TW)

(73) Assignee: Fortune Electric Co., Ltd., Taipei (TW)

( * ) Notice: Subject to any disclaimer, the term of this patent is extended or adjusted under 35 U.S.C. 154(b) by 174 days.

(21) Appl. No.: 15/169,834

(22) Filed: Jun. 1, 2016

(65) Prior Publication Data

US 2017/0352465 A1 Dec. 7, 2017

(51) Int. Cl.
*F24F 11/00* (2018.01)
*H01F 27/12* (2006.01)

(52) U.S. Cl.
CPC ..... *H01F 27/12* (2013.01)

(58) Field of Classification Search
CPC ..... F24F 11/00; G05D 23/19; G05D 23/00
See application file for complete search history.

(56) References Cited

U.S. PATENT DOCUMENTS 5,445,128 A * 8/1995 Letang ..... B60K 31/045 123/436
2013/0284419 A1* 10/2013 Collins ..... A01D 41/12 165/287
2017/0032890 A1* 2/2017 Lin ..... H01F 27/33

* cited by examiner

*Primary Examiner* — Ljiljana Ciric
*Assistant Examiner* — Alexis Cox
(74) *Attorney, Agent, or Firm* — Alan D. Kamrath; Kamrath IP Lawfirm, P.A.

(57) ABSTRACT

A cooling fan variable-frequency control system for a power transformer includes a control device and a fan unit. The control device includes a microprocessor that is set with a first temperature range, a second temperature range higher than the first temperature range, and a fan switching time. The microprocessor is connected to a temperature sensor for detecting a temperature of an insulating oil in a power transformer. A variable-frequency controller and a fixed-frequency controller are connected to the microprocessor and are connected to a switching controller. The fan unit is connected to the switching controller and includes first and second fans. The microprocessor controls the switching controller according to the fan switching time to thereby control the variable-frequency controller to connect with the first fan or the second fan. The first fan and the second fan can operate at a fixed frequency and at a variable frequency.

3 Claims, 2 Drawing Sheets

COOLING FAN VARIABLE-FREQUENCY CONTROL SYSTEM FOR A POWER TRANSFORMER

BACKGROUND OF THE INVENTION

The present invention relates to a cooling fan variable-frequency control system for a power transformer and, more particularly, to a cooling fan variable-frequency control system for a power transformer including a plurality of fans controlled by variable and fixed frequencies to save the electricity while reducing the costs of the variable-frequency control system.

A housing of a super high voltage transformer for transmitting electricity is generally a hollow, closed, parallelepiped placed on the ground. An iron core and windings are placed in an interior of the housing that is filled with a transformer oil (an insulating oil) for cooperating with heat dissipators of cooling systems on two sides of the housing for rapid heat dissipation, such that the power transformer can maintain at a normal working temperature, avoiding shortening of the service life and damage.

The above cooling systems use fans and the insulating oil to proceed with heat exchange. The number of fans is increased when the power transformer is larger. Although variable-frequency control can be used to control the fans to rotate at suitable speeds to achieve the energy saving effect, the fans must be equipped with variable-frequency controllers to vary the frequency. Furthermore, using more fans increases the costs of the variable-frequency control system.

Thus, a need exists for a novel device that mitigates and/or obviates the above disadvantages.

BRIEF SUMMARY OF THE INVENTION

The primary objective of the present invention is to provide a cooling fan variable-frequency control system for a power transformer including a plurality of fans controlled by variable frequency and fixed frequency to save the costs of the variable-frequency control system.

Another objective of the present invention is to use a switching controller to make a plurality of fans to operate in sequence at fixed frequency and variable frequency, such that the fans have a longer service life, avoiding frequent replacement or maintenance.

To fulfill the above objective, the present invention provides a cooling fan variable-frequency control system for a power transformer. The control system includes a control device and a fan unit. The control device includes a microprocessor that is set with a first temperature range, a second temperature range, and a fan switching time. The second temperature range is higher than the first temperature range. The microprocessor is connected to a temperature sensor for detecting a temperature of an insulating oil in a power transformer. A variable-frequency controller and a fixed-frequency controller are connected to the microprocessor. The variable-frequency controller and the fixed-frequency controller are connected to a switching controller. The fan unit is connected to the switching controller of the control device and includes a first fan and a second fan.

The microprocessor controls the switching controller according to the fan switching time to thereby control the variable-frequency controller to connect with the first fan or the second fan. When the variable-frequency controller is connected to the first fan, the switching controller makes the fixed-frequency controller connect with the second fan. When the variable-frequency controller is connected to the second fan, the switching controller makes the fixed-frequency controller connect with the first fan.

The temperature detector continuously detects the temperature and sends the temperature to the microprocessor. When the temperature received by the microprocessor is in the first temperature range, the microprocessor controls the variable-frequency controller to activate the first fan or the second fan, and the rotational speed of the first fan or the second fan is controlled based on the temperature. When the temperature received by the microprocessor is in the second temperature range, the microprocessor controls the variable-frequency controller to activate the first fan or the second fan and controls the fixed-frequency controller to activate the second fan or the first fan, and the rotational speed of the first fan or the second fan is controlled based on the temperature.

In an example, the microprocessor of the control device is further set with a third temperature range higher than the second temperature range, and the fan unit further includes a third fan. The microprocessor controls the switching controller according to the fan switching time to thereby control the variable-frequency controller to connect with the first fan, the second fan, or the third fan. When the variable-frequency controller is connected to the first fan, the switching controller makes the fixed-frequency controller connect with the second and third fans. When the variable-frequency controller is connected to the second fan, the switching controller makes the fixed-frequency controller connect with the first and third fans. When the variable-frequency controller is connected to the third fan, the switching controller makes the fixed-frequency controller connect with the first and second fans. When the temperature received by the microprocessor is in the third temperature range, the microprocessor controls the variable-frequency controller to activate the first fan, the second fan, or the third fan and controls the fixed-frequency controller to activate the second and third fans, to activate the first and third fans, or to activate the first and second fans, and the rotational speed of the first fan, the second fan, or the third fan is controlled based on the temperature.

In another example, a loop controller is connected between the microprocessor and the variable-frequency controller and connected to the fixed-frequency controller. A control signal sent from the microprocessor to the variable-frequency controller passes through the loop controller to the variable-frequency controller to activate the first fan or the second fan. When the variable-frequency controller malfunctions, the loop controller transfers the control signal from the microprocessor to the fixed-frequency controller to activate the first fan or the second fan that is supposed to operate at a variable frequency.

The present invention will become clearer in light of the following detailed description of illustrative embodiments of this invention described in connection with the drawings.

DETAILED DESCRIPTION OF THE INVENTION

Figure 1:
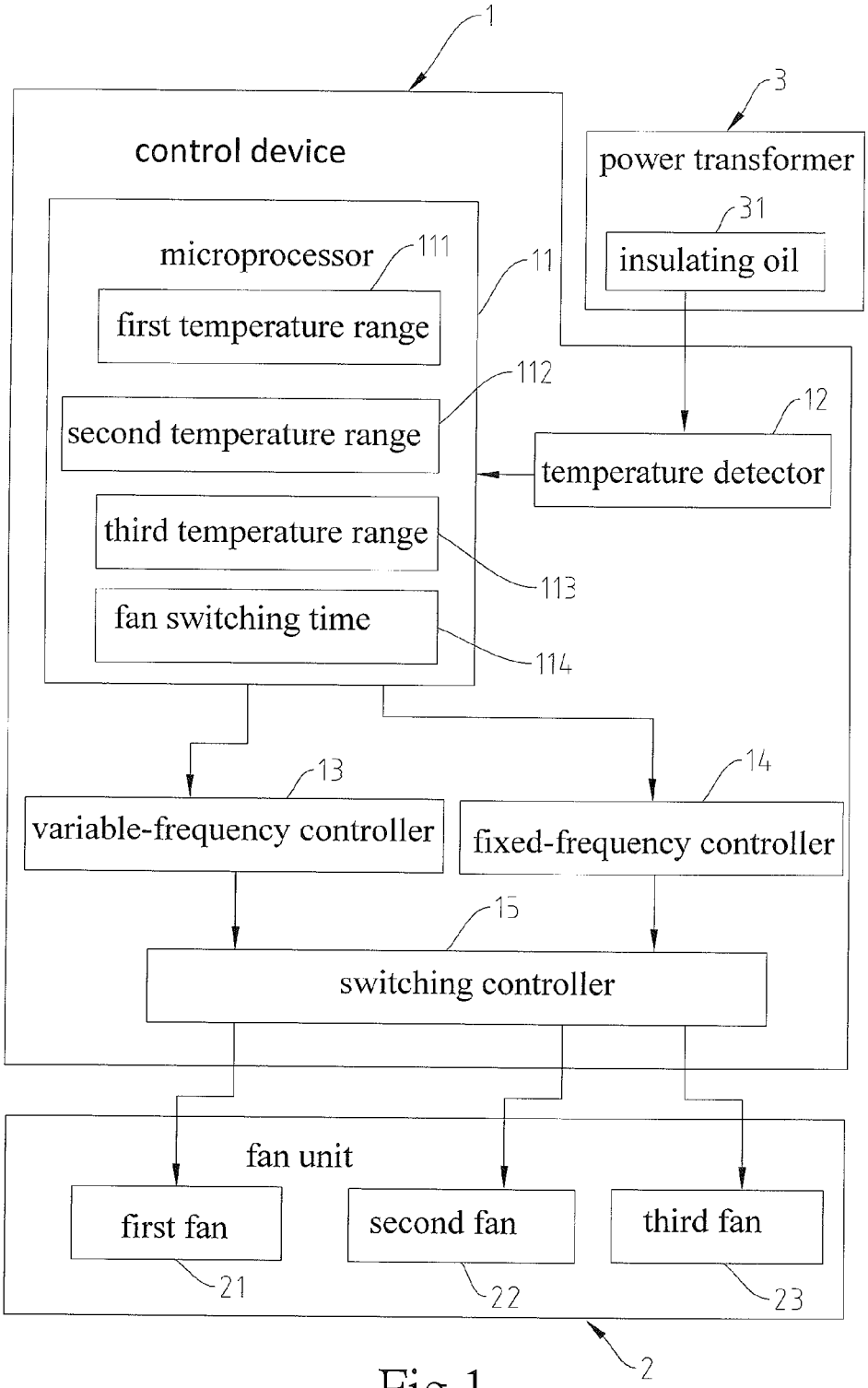
FIG. 1 is a block diagram of a cooling fan variable-frequency control system for a power transformer of a first example according to the present invention.

With reference to FIG. 1, a cooling fan variable-frequency control system for a power transformer of a first example according to the present invention includes a control device 1 and a fan unit 2. The control device 1 includes a microprocessor 11 connected to a temperature sensor 12 for detecting a temperature of an insulating oil 31 in a power transformer 3. The microprocessor 11 is connected to a variable-frequency controller 13 and a fixed-frequency controller 14 connected to the microprocessor 11. The variable-frequency controller 13 and the fixed-frequency controller 14 are connected to a switching controller 15. The microprocessor 11 is set with a first temperature range 111, a second temperature range 112, a third temperature range 113, and a fan switching time 114. The second temperature range 112 is higher than the first temperature range 111, and the third temperature range 113 is higher than the second temperature range 112.

The fan unit 2 is mounted to a location related to a heat dissipator (not shown) of an external cooling system (not shown) of the power transformer 3. The fan unit 2 including a first fan 21, a second fan 22, and a third fan 23. The first, second, and third fans 21, 22, and 23 are respectively connected to the switching controller 15 of the control device 1.

The temperature detector 12 continuously detects the temperature and sends the temperature to the microprocessor 11. The switching controller 15 of the microprocessor 11 sets the operation mode of the first, second, and third fans 21, 22, and 23 based on the temperature. Namely, the microprocessor 11 controls the switching controller 15 according to the fan switching time 114 to thereby control the variable-frequency controller 13 to connect with the first fan 21, the second fan 22, or the third fan 23. When the variable-frequency controller 13 is connected to the first fan 21, the first fan 21 operates in a variable-frequency mode, and the switching controller 15 makes the fixed-frequency controller 14 connect with the second and third fans 22 and 23, such that the second and third fans 22 and 23 operate in a fixed-frequency mode. When the variable-frequency controller 13 is connected to the second fan 22, the switching controller 15 makes the fixed-frequency controller 14 connect with the first and third fans 21 and 23. When the variable-frequency controller 13 is connected to the third fan 23, the switching controller 15 makes the fixed-frequency controller 14 connect with the first and second fans 21 and 22. Thus, the first, second, and third fans 21, 22, and 23 change their operation modes in sequence and, thus, have a longer service life.

When the temperature received by the microprocessor 11 is in the first temperature range 111, the microprocessor 11 controls the variable-frequency controller 13 to activate the first fan 21, the second fan 22, or the third fan 23. If the first fan 23 is connected to the variable-frequency controller 13, the variable-frequency controller 13 activates the first fan 21 and controls the rotational speed of the first fan 21 based on the temperature in the first temperature range 111. The higher the temperature, the faster the rotational speed of the first fan 21.

When the temperature received by the microprocessor 11 is in the second temperature range 112, the microprocessor 11 controls the variable-frequency controller 13 to activate the first fan 21 and controls the fixed-frequency controller 14 to activate the second fan 22. Furthermore, the rotational speed of the first fan 21 is controlled based on the temperature in the second temperature range 112.

When the temperature received by the microprocessor 11 is in the third temperature range 113, the microprocessor 11 controls the variable-frequency controller 13 to activate the first fan 21 and controls the fixed-frequency controller 14 to activate the second and third fans 22 and 23. Furthermore, the rotational speed of the first fan 21 is controlled based on the temperature in the third temperature range 113.

If the variable-frequency controller 13 is connected to the second fan 22, the first and third fans 21 and 23 are activated in sequence to operate at a fixed frequency when the temperature received by the microprocessor 11 is in the second temperature range 112 or the third temperature range 113.

If the variable-frequency controller 13 is connected to the third fan 23, the first and second fans 21 and 22 are activated in sequence to operate at a fixed frequency when the temperature received by the microprocessor 11 is in the second temperature range 112 or the third temperature range 113.

Figure 2:
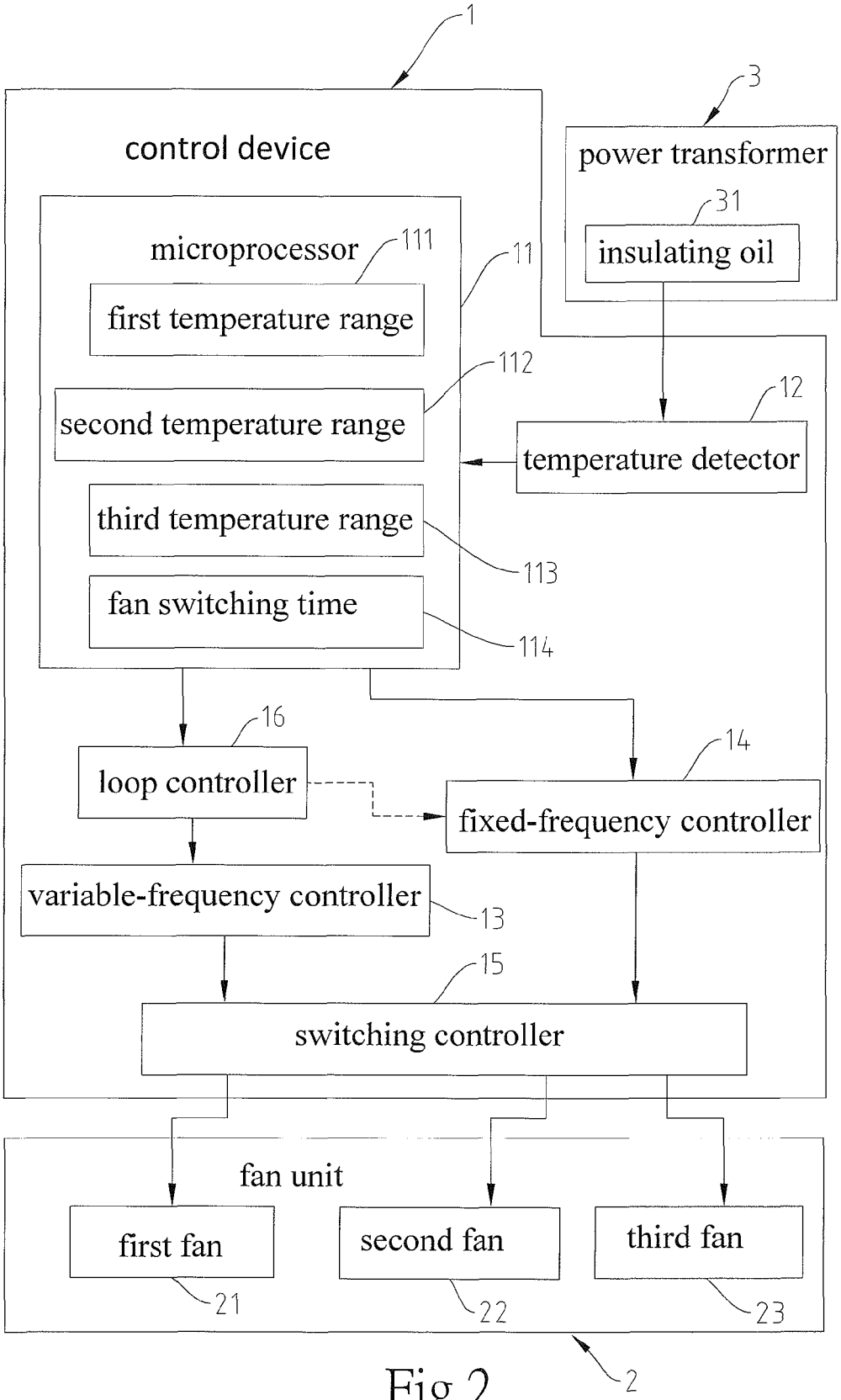
FIG. 2 is a block diagram of a cooling fan variable-frequency control system for a power transformer of a second example according to the present invention.

FIG. 2 is a block diagram of a cooling fan variable-frequency control system for a power transformer of a second example according to the present invention. The second example is different from the first example by that a loop controller 16 is connected between the microprocessor 11 and the variable-frequency controller 13 and is connected to the fixed-frequency controller 14. When the variable-frequency controller 13 operates normally, a control signal sent from the microprocessor 11 to the variable-frequency controller 13 passes through the loop controller 16 to the variable-frequency controller 13 to activate the first fan 21 or the second fan 22 to operate at a variable frequency. When the variable-frequency controller 13 malfunctions, the loop controller 16 transfers the control signal from the microprocessor 11 to the fixed-frequency controller 14 to activate the first fan 21, the second fan 22, or the third fan 23 to operate at a fixed frequency (the first fan 21, the second fan 22, or the third fan 23 is supposed to operate at a variable frequency), assuring normal heat dissipation of the power transformer 3 by the fan unit 2 when the variable-frequency controller 13 malfunctions.

Although specific embodiments have been illustrated and described, numerous modifications and variations are still possible without departing from the scope of the invention. The scope of the invention is limited by the accompanying claims.

The invention claimed is:

1. A cooling fan variable-frequency control system for a power transformer, comprising:

a control device including a microprocessor, with the microprocessor being set with a first temperature range, a second temperature range, and a fan switching time, with the second temperature range being higher than the first temperature range, with the microprocessor connected to a temperature sensor for detecting a temperature of an insulating oil in a power transformer, with a variable-frequency controller and a fixed-frequency controller connected to the microprocessor, and with the variable-frequency controller and the fixed-frequency controller connected to a switching controller; and a fan unit connected to the switching controller of the control device, with the fan unit including a first fan and a second fan, wherein the microprocessor controls the switching controller according to the fan switching time to thereby control the variable-frequency controller to connect with the first fan or the second fan, wherein when the variable-frequency controller is connected to the first fan, the switching controller makes the fixed-frequency controller connect with the second fan, wherein when the variable-frequency controller is connected to the second fan, the switching controller makes the fixed-frequency controller connect with the first fan, wherein the temperature detector continuously detects the temperature and sends the temperature to the microprocessor, wherein when the temperature received by the microprocessor is in the first temperature range, the microprocessor controls the variable-frequency controller to activate the first fan or the second fan, and the rotational speed of the first fan or the second fan is controlled based on the temperature, wherein when the temperature received by the microprocessor is in the second temperature range, the microprocessor controls the variable-frequency controller to activate the first fan or the second fan and controls the fixed-frequency controller to activate the second fan or the first fan, and the rotational speed of the first fan or the second fan is controlled based on the temperature.

2. The cooling fan variable-frequency control system for a power transformer as claimed in claim 1, with the microprocessor of the control device being further set with a third temperature range higher than the second temperature range, with the fan unit further including a third fan, wherein the microprocessor controls the switching controller according to the fan switching time to thereby control the variable-frequency controller to connect with the first fan, the second fan, or the third fan, wherein when the variable-frequency controller is connected to the first fan, the switching controller makes the fixed-frequency controller connect with the second and third fans, wherein when the variable-frequency controller is connected to the second fan, the switching controller makes the fixed-frequency controller connect with the first and third fans, wherein when the variable-frequency controller is connected to the third fan, the switching controller makes the fixed-frequency controller connect with the first and second fans, wherein when the temperature received by the microprocessor is in the third temperature range, the microprocessor controls the variable-frequency controller to activate the first fan, the second fan, or the third fan and controls the fixed-frequency controller to activate the second and third fans, to activate the first and third fans, or to activate the first and second fans, and the rotational speed of the first fan, the second fan, or the third fan is controlled based on the temperature.

3. The cooling fan variable-frequency control system for a power transformer as claimed in claim 1, further comprising a loop controller connected between the microprocessor and the variable-frequency controller and connected to the fixed-frequency controller, wherein a control signal sent from the microprocessor to the variable-frequency controller passes through the loop controller to the variable-frequency controller to activate the first fan or the second fan, wherein when the variable-frequency controller malfunctions, the loop controller transfers the control signal from the microprocessor to the fixed-frequency controller to activate the first fan or the second fan that is supposed to operate at a variable frequency.

* * * * *